US009108294B2

(12) United States Patent
Yagi et al.

(10) Patent No.: US 9,108,294 B2
(45) Date of Patent: Aug. 18, 2015

(54) GRINDING DEVICE

(75) Inventors: Tsuyoshi Yagi, Iwata (JP); Koji Ono, Iwata (JP)

(73) Assignee: NTN CORPORATION, Osaka (JP)

( * ) Notice: Subject to any disclaimer, the term of this patent is extended or adjusted under 35 U.S.C. 154(b) by 851 days.

(21) Appl. No.: 13/319,533

(22) PCT Filed: Jun. 14, 2010

(86) PCT No.: PCT/JP2010/060045

§ 371 (c)(1),
(2), (4) Date: Nov. 9, 2011

(87) PCT Pub. No.: WO2010/147086

PCT Pub. Date: Dec. 23, 2010

(65) Prior Publication Data

US 2012/0058716 A1 Mar. 8, 2012

(30) Foreign Application Priority Data

Jun. 15, 2009 (JP) ..... 2009-142269

(51) Int. Cl.
*B24B 53/02* (2012.01)
*B24B 53/053* (2006.01)

(52) U.S. Cl.
CPC ..... *B24B 53/053* (2013.01)

(58) Field of Classification Search
CPC ..... B24B 53/053; B24B 53/02; B24B 53/00
USPC ..... 451/72
IPC ..... B24B 53/53, 53/02, 7/04, 53/00
See application file for complete search history.

(56) References Cited

U.S. PATENT DOCUMENTS 3,842,543 A * 10/1974 Hohler et al. ..... 451/72
4,404,774 A * 9/1983 Sadao ..... 451/15

(Continued)

FOREIGN PATENT DOCUMENTS

DE 3315196 A1 * 4/1983
DE 4108740 A1 * 9/1992 ..... B24B 49/14

(Continued)

OTHER PUBLICATIONS

Machine translation into English of JPH05185372A (JPH05185372A—English Machine Translation.PDF).*

(Continued)

*Primary Examiner* — Joseph J Hail
*Assistant Examiner* — Marc Carlson
(74) *Attorney, Agent, or Firm* — Wenderoth, Lind & Ponack, L.L.P.

(57) ABSTRACT

A grinding device includes a dresser head (7) at the front end of a spindle (1), and a dresser tool (8) mounted on the dresser head (7) for dressing the grinder (6). The dresser tool (8) is configured such that while the workpiece (W) is being ground by the grinder (6), the dresser tool (8) is out of contact with the grinder (6), and while the grinder (6) is being dressed by the dresser tool (8), the chuck (3) is out of contact with the grinder (6). Thus it is possible to press the dresser tool (8) against the grinder (6) using relative movement between the spindle (1) and the grinder shaft (4). The dresser head (7) can be rotated by rotating the spindle (1). The grinder (6) can thus be dressed without the need to mount the dresser tool (8) every time the grinder is to be dressed.

9 Claims, 9 Drawing Sheets

(56) References Cited

U.S. PATENT DOCUMENTS

| | | | | |
|---|---|---|---|---|
| 4,417,422 | A * | 11/1983 | Redeker et al. | 451/143 |
| 6,634,924 | B1 * | 10/2003 | Ono et al. | 451/5 |
| 6,997,778 | B2 * | 2/2006 | Ono et al. | 451/8 |
| 2004/0033761 | A1 * | 2/2004 | Ono et al. | 451/8 |
| 2006/0292969 | A1 * | 12/2006 | Hoshino et al. | 451/56 |
| 2009/0203296 | A1 * | 8/2009 | Braig et al. | 451/56 |
| 2009/0280726 | A1 * | 11/2009 | Kasuga et al. | 451/56 |
| 2011/0034112 | A1 * | 2/2011 | Sugano | 451/56 |

FOREIGN PATENT DOCUMENTS

| | | | | |
|---|---|---|---|---|
| DE | 4136566 | C1 * | 4/1993 | |
| DE | 102005047114 | A1 * | 4/2006 | |
| EP | 1974860 | A1 * | 10/2008 | B24B 53/053 |
| EP | 2080590 | A1 * | 7/2009 | B24B 53/00 |
| EP | 1426140 | B1 * | 7/2013 | |
| GB | 2288758 | B * | 10/1997 | |
| JP | 2-56561 | | 4/1990 | |
| JP | H0256561 | U * | 4/1990 | |
| JP | 5-185372 | | 7/1993 | |
| JP | H05185372 | A * | 7/1993 | |
| JP | 7-186017 | | 7/1995 | |
| JP | 7046457 | Y2 * | 10/1995 | |
| JP | 8-229815 | | 9/1996 | |
| JP | 2006-095663 | | 4/2006 | |
| JP | 2009095952 | A * | 5/2009 | |
| JP | 2009142906 | A * | 7/2009 | |
| WO | WO 2009125835 | A1 * | 10/2009 | B24B 53/02 |

OTHER PUBLICATIONS

JP 2009-095952A—May 2009—English Translation.*

English translation of the Written Opinion of the International Searching Authority issued Jul. 13, 2010 in PCT/JP2010/060045.

International Search Report issued Jul. 13, 2010 in International (PCT) Application No. PCT/JP2010/060045.

* cited by examiner

GRINDING DEVICE

TECHNICAL FIELD

The present invention relates to a grinding device having the function of dressing a grinder.

BACKGROUND ART

A grinding device such as a surface grinding machine or a cylindrical grinding machine includes a rotary spindle, chuck mounted on the front end of the spindle for fixing a workpiece, a rotary grinder shaft having a grinder head, and a grinder mounted on the grinder head. By moving the spindle and the grinder shaft in the axial direction of the spindle or in a direction perpendicular to the axis of the spindle, the workpiece is ground by the grinder.

Some of such grinding devices include a dresser which can dress the grinder without the need to dismount the grinder from the grinder head (see e.g. JP Patent Publication 8-229815A and JP Patent Publication 2006-95663A).

The grinding device disclosed in JP Patent Publication 8-229815A includes a grinder shaft carrying a grinder, and a dresser head support base having a pivotable pivot shaft extending parallel to the grinder shaft. The dresser head support base further includes a spindle extending parallel to the pivot shaft to which a dressing member as a dresser tool is detachably mounted. By pivoting the pivot shaft, the dressing member is pressed against the grinder. The dresser head support base carries a motor whose rotation is transmitted to the spindle through a gear transmission mechanism.

The grinding device disclosed in JP Patent Publication 2006-95663A includes a main spindle head to which both a workpiece and a dresser tool are attached. In particular, after dismounting the workpiece, the dresser tool is attached to the main spindle head to dress the grinder mounted on the grinder head.

The grinding device disclosed in JP Patent Publication 8-229815A needs the dresser head support base including the pivot shaft, the motor for rotating the spindle carrying the dressing member, and the gear transmission mechanism. Thus, the dressing mechanism is large in size and complicated in structure, so that its manufacturing cost is high. The dressing mechanism of the grinding device disclosed in JP Patent Publication 2006-95663A is simple in structure. But it is necessary to mount the dresser tool on the main spindle head after dismounting the workpiece every time the grinder is dressed, which is troublesome.

SUMMARY OF THE INVENTION

An object of the present invention is to provide a grinding device having a dressing mechanism for dressing a grinder, which is simple in structure and low in manufacturing cost.

In order to achieve the above object, the present invention provides a grinding device comprising a spindle which is configured to be rotated, a chuck mounted on a front end of the spindle for fixing a workpiece, a grinder shaft having a grinder head, and a grinder mounted on the grinder head, wherein the spindle and the grinder shaft are movable relative to each other to a position where the workpiece can be ground by the grinder with the grinder fixed in position to the chuck, wherein the grinding device further comprises a dresser head provided at the front end of the spindle, and a dresser tool mounted on the dresser head for dressing the grinder, and wherein the dresser tool is configured such that while the workpiece is being ground by the grinder, the dresser tool is kept out of contact with the grinder, and while the grinder is being dressed by the dresser tool, the chuck is kept out of contact with the grinder.

Since the grinding device further comprises a dresser head provided at the front end of the spindle, and a dresser tool mounted on the dresser head for dressing the grinder, and the dresser tool is configured such that while the workpiece is being ground by the grinder, the dresser tool is kept out of contact with the grinder, and while the grinder is being dressed by the dresser tool, the chuck is kept out of contact with the grinder, it is possible to press the dresser tool against the grinder using the relative movement between the spindle and the grinder shaft. The dresser head can be rotated by rotating the spindle. The grinder can thus be easily dressed by a dressing structure that is simple in structure without the need to mount the dresser tool every time the grinder is to be dressed. Since the grinding device of this invention allows grinding of the workpiece with the dresser tool mounted on the grinding device, it is possible to easily provide the grinding device of this invention with the automatic skip dressing function, which is the function of automatically dressing the grinder every time a predetermined number of workpieces have been ground or a predetermined time period has passed during automatic operation of the device. Thus, the grinding device of this invention is suitable for use in an automatic processing line too.

In a preferred arrangement, the chuck and the dresser head are movable relative to each other in an axial direction of the spindle such that the positional relationship between the chuck and the dresser head during grinding is different from the positional relationship therebetween during dressing. With this arrangement, the dresser tool can be moved sufficiently spaced apart from the grinder so as not to interfere with the grinder while the workpiece is being ground by the grinder.

The dresser head is preferably fixed in position at a location radially outwardly of the chuck.

The grinding device may be a surface grinding machine wherein the spindle and the grinder shaft extend parallel to each other.

Alternatively, the grinding device may be a surface grinding machine wherein the spindle and the grinder shaft extend perpendicular to each other.

The grinder may be configured to grind a radially inner surface of the workpiece.

The grinder may also be configured to grind a radially outer surface of the workpiece.

Since the grinding device further comprises a dresser head provided at the front end of the spindle, and a dresser tool mounted on the dresser head for dressing the grinder, and the dresser tool is configured such that while the workpiece is being ground by the grinder, the dresser tool is kept out of contact with the grinder, and while the grinder is being dressed by the dresser tool, the chuck is kept out of contact with the grinder, the grinder can be easily dressed by a dressing structure that is simple in structure, and its manufacturing cost is low. Further, since the grinding device of this invention allows grinding of the workpiece with the dresser tool mounted on the grinding device, it is possible to easily provide the grinding device of this invention with the automatic skip dressing function, which is the function of automatically dressing the grinder every time a predetermined number of workpieces have been ground or a predetermined time period has passed during automatic operation of the device. Thus, the grinding device of this invention is suitable for use in an automatic processing line too.

BRIEF DESCRIPTION OF THE DRAWINGS

FIG. 4(*b*) is a sectional view taken along line IV-IV of FIG. 4(*a*).

DETAILED DESCRIPTION OF THE INVENTION

Figure 1:
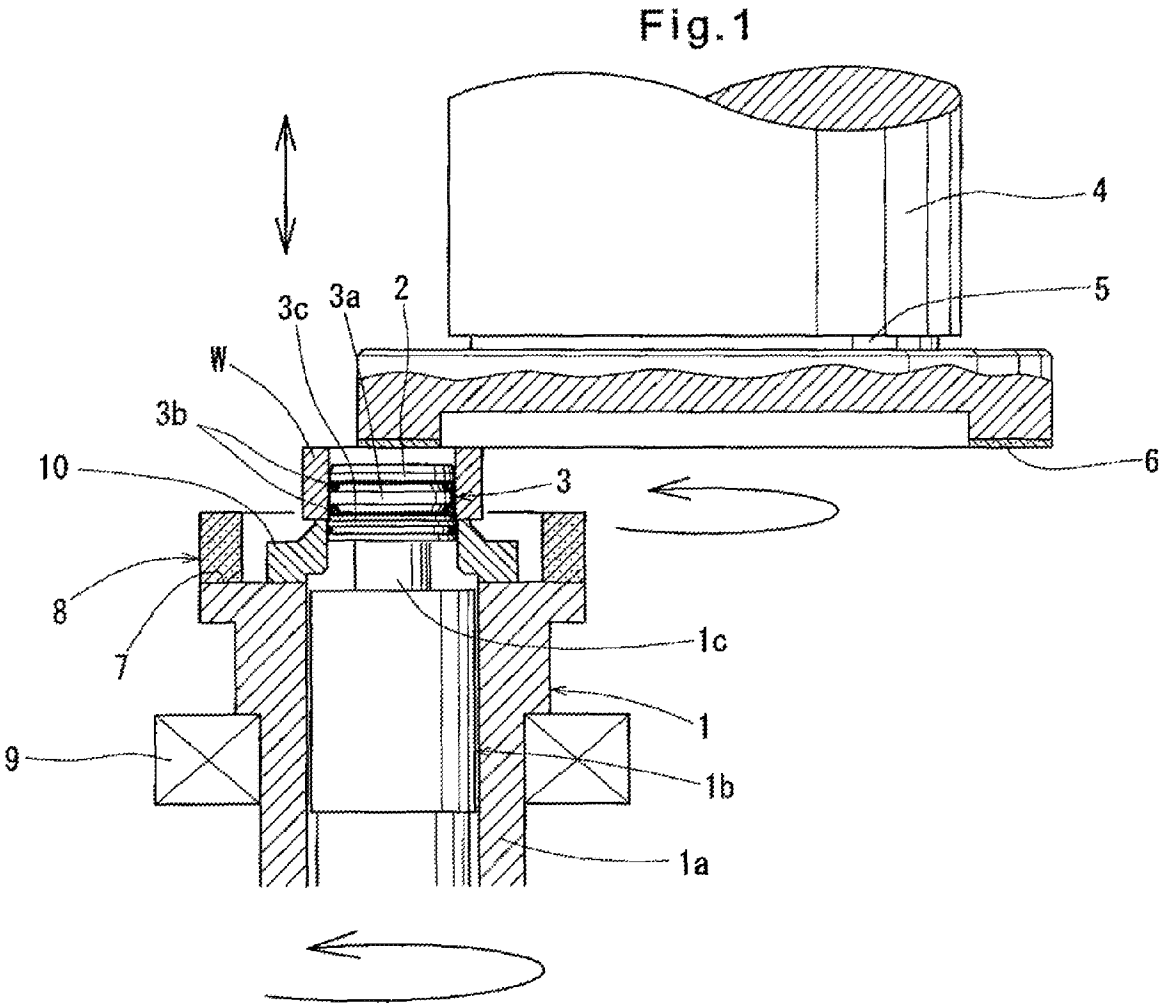
FIG. 1 is a vertical sectional view of a portion of a grinding device according to a first embodiment of the present invention.
Figure 2A:
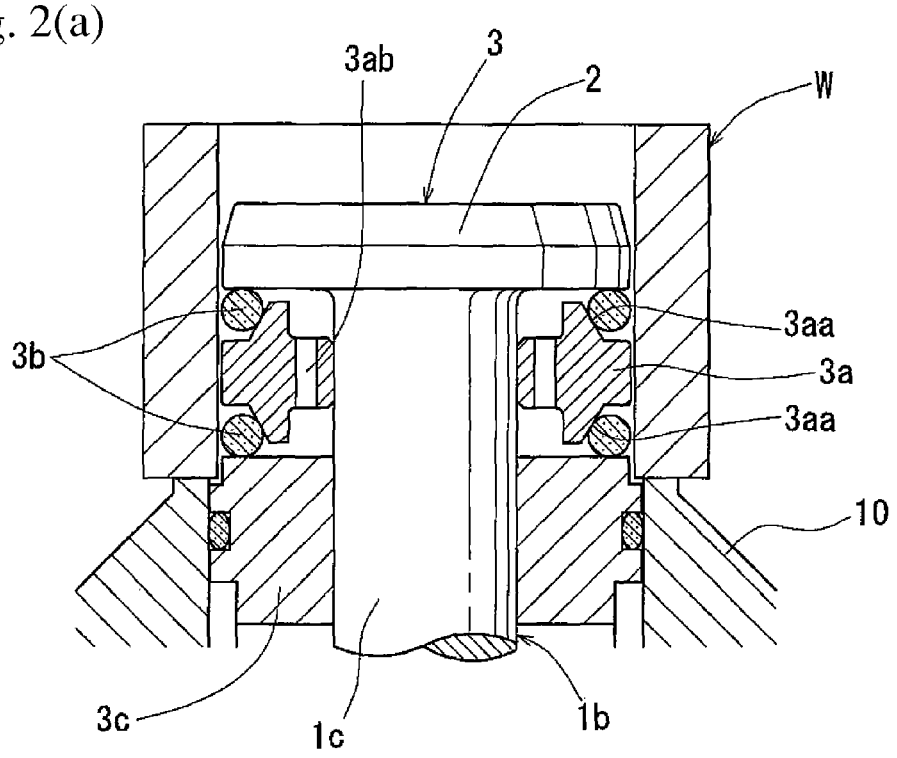
FIGS. 2(*a*) and 2(*b*) are vertical sectional views of a portion of the grinding device of FIG. 1, showing how a workpiece is fixed in position by a chuck.
Figure 2B:
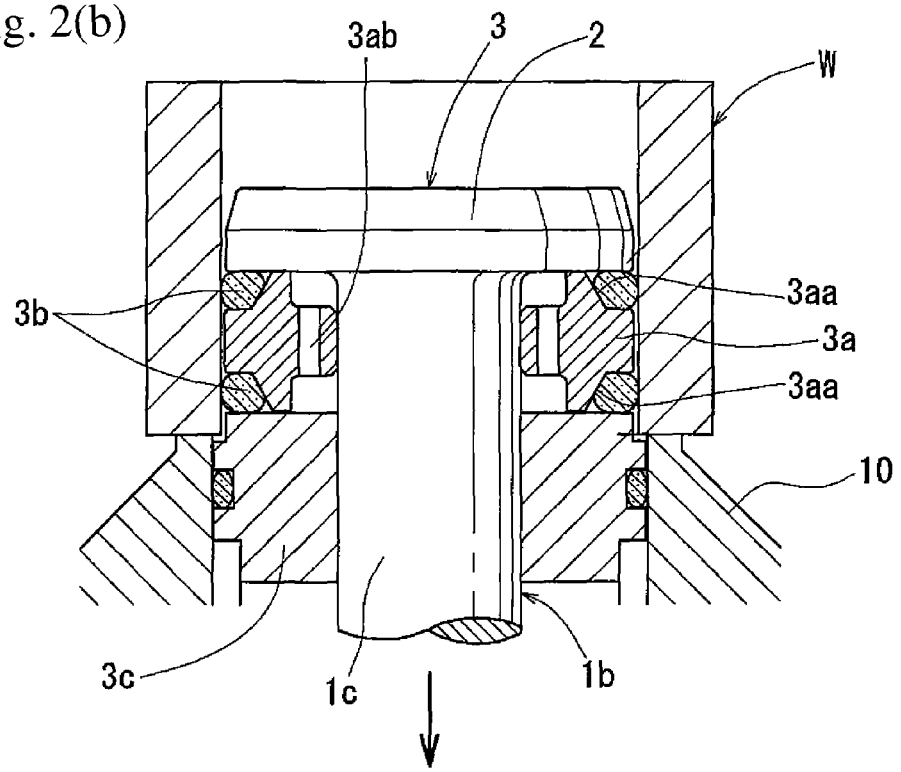
Figure 3:
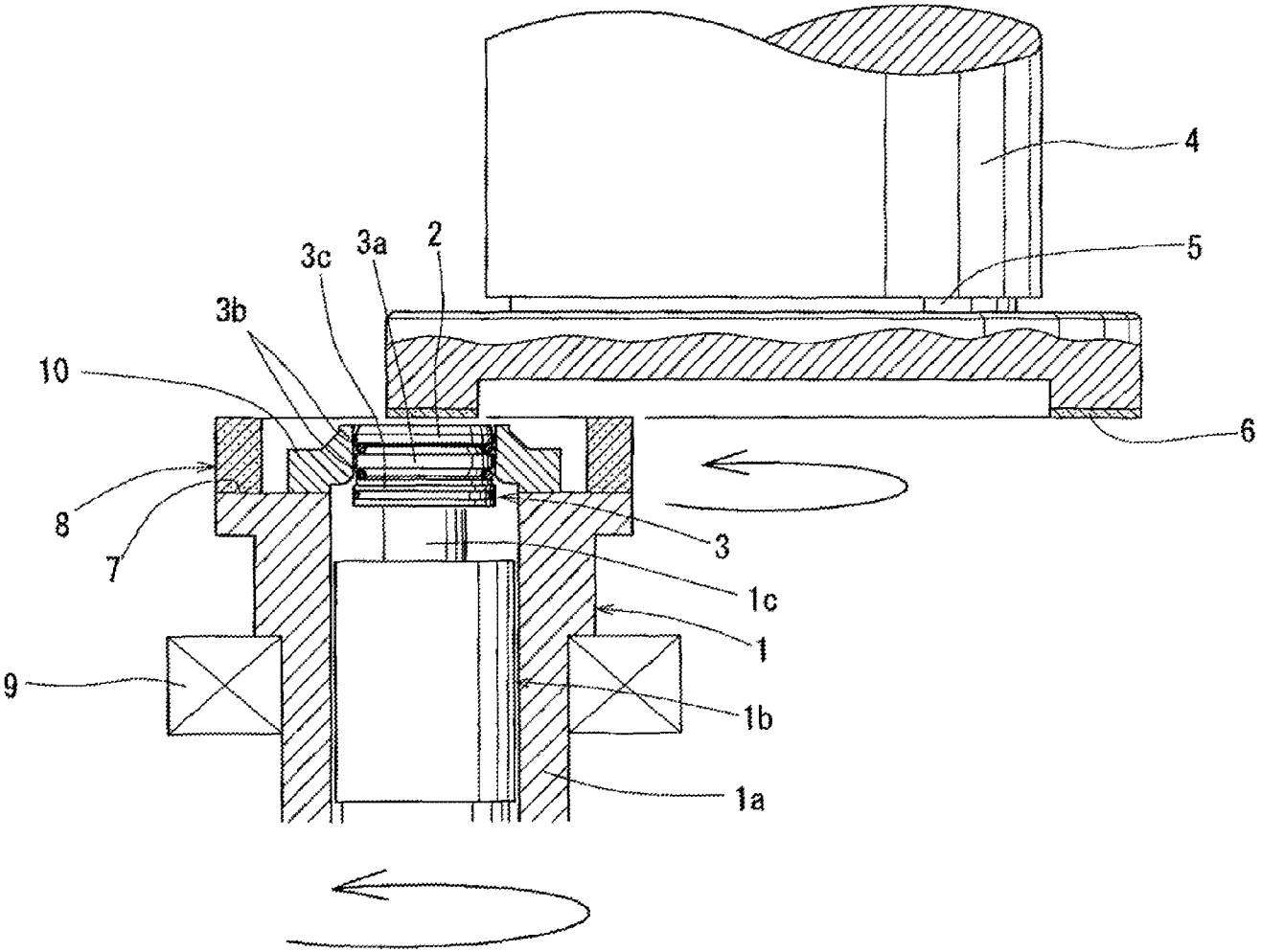
FIG. 3 is a vertical sectional view of the grinding device of FIG. 1, showing how the grinder is dressed.

Now the embodiments of the present invention are described with reference to the drawings. FIGS. 1-3 show the first embodiment. As shown in FIG. 1, the grinding device of the first embodiment is a surface grinding machine comprising a spindle 1, which is rotated, a chuck 3 which is provided at the front end of the spindle 1 and on which a cylindrical workpiece W can be fixedly mounted, and a grinder shaft 4, which is rotated and extends parallel to the spindle 1, the grinder shaft 4 having a grinder head 5 on which a grinder 6 is mounted for grinding an end surface of the workpiece W. The spindle 1 has a dresser head 7 on which a ring-shaped dresser tool 8 is mounted which is located radially outwardly of the chuck 3.

The spindle 1 comprises an outer cylindrical member 1*a* rotatably supported by a bearing 9, and a shaft member 1*b* inserted in the outer cylindrical member 1*a* so as to be slidable but rotationally fixed relative to the outer cylindrical member 1*a* and adapted to be axially moved. The chuck 3 is provided at the front end of the shaft member 1*b*. The workpiece W is axially fixed in position by a fixing ring 10 mounted on the front end of the outer cylindrical member 1*a*.

As shown in FIGS. 2(*a*) and 2(*b*), the chuck 3 comprises a clamp ring 3*a* fitted on a neck portion 1*c* of the shaft member 1*b* in the rear of a large-diameter head 2 at the front end of the neck portion 1*c*, a pair of O-rings 3*b* fitted on respective radially outer tapered surfaces 3*aa* on both sides of the clamp ring 3*a*, and a base ring 3*c* fitted on the neck portion 1*c* in the rear of the clamp ring 3*a*. The clamp ring 3*a* has air vent holes 3*ab* through which air in the space between the head 2 and the clamp ring 3*a* can be expelled.

As shown in FIG. 2(*a*), with the chuck 3 advanced together with the shaft member 1*b*, the workpiece W is fitted on the head 2 until its axial bottom end abuts the fixing ring 10. Then, as shown in FIG. 2(*b*), the shaft member 1*b* is moved backward until the clamp ring 3*a* is pressed by the head 2 and the base ring 3*c* and the O-rings 3*b* fitted on the respective radially outer tapered surfaces 3*aa* are compressed and radially expand so as to be pressed against the radially inner surface of the workpiece W, which is cylindrical. The workpiece W is thus fixed in position.

FIG. 1 shows how the workpiece W is ground by the grinder 6. In this state, the grinder shaft 4, which is axially movable, is advanced and the cup-shaped grinder 6 mounted on the rotating grinder head 5 is pressed against the end surface of the workpiece W, which is fixed to the chuck 3 at the front end of the spindle 1, which is also rotating.

FIG. 3 shows how the grinder 6 is dressed by the dresser tool 8. In this state, with the workpiece W removed, the chuck 3 is retracted into the fixing ring 10, which is mounted on the front end of the outer cylindrical member 1*a*. On the other hand, the grinder shaft 4 is advanced further than during grinding so that the grinder 6 is pressed against the end surface of the ring-shaped dresser tool 8 mounted on the dresser head 7, which is rotating. If the grinder 6 is an ultrafine grinder such as a resinoid bonded CBN grinder, the dresser tool 8 is a dressing stone using abrasive grains made of alumina or silicon carbide, or X-Power (trade name, made by SAN-EI SEIKO Co., Ltd.), which contains a Group 5A metal. If the grinder is another ordinary grinder, a diamond dresser is used as the dresser tool 8.

Figure 4B:
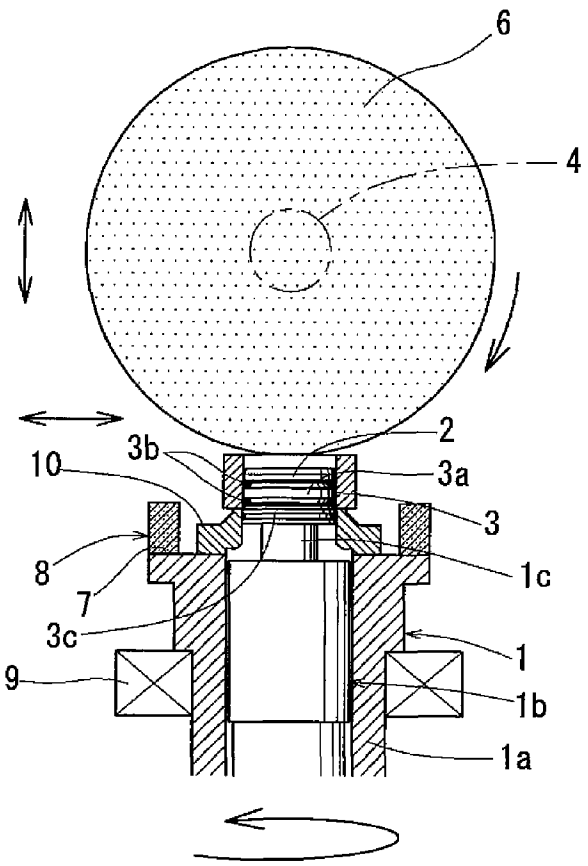
FIG. 4(*a*) is a vertical sectional view of a portion of a grinding device according to a second embodiment of the present invention.
Figure 4A:
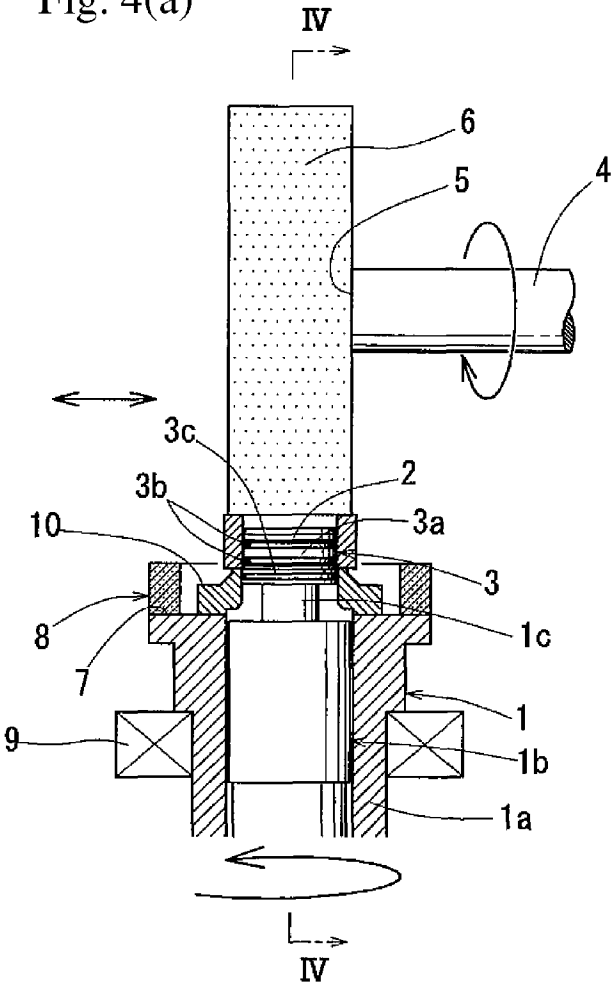

FIGS. 4(*a*), 4(*b*) and 5 show a grinding device of the second embodiment, which is also a surface grinding machine, of which the spindle 1, and as shown in FIGS. 4(*a*) and 4(*b*), the chuck 3 and the dresser head 7 at the front end of the spindle 1 are identical to those of the first embodiment. This embodiment differs from the first embodiment in that grinder shaft 4, which is rotated, extends perpendicular to the spindle 1, and that a disk-shaped grinder 6 is mounted on the grinder head 5. The grinder shaft 4 is movable in its axial direction, and in horizontal and vertical directions, which are perpendicular to the axis of the grinder shaft 4.

FIGS. 4(*a*) and 4(*b*) show how a workpiece W, which is mounted on the chuck 3 at the front end of the rotating spindle 1, is ground by the grinder 6. In this state, with the grinder shaft 4 moved downward, and the disk-shaped grinder 6, which is mounted on the rotating grinder head 5, pressed against the end surface of the workpiece W, the grinder shaft 4 is reciprocated in the axial direction to grind the surface of the workpiece W.

Figure 5:
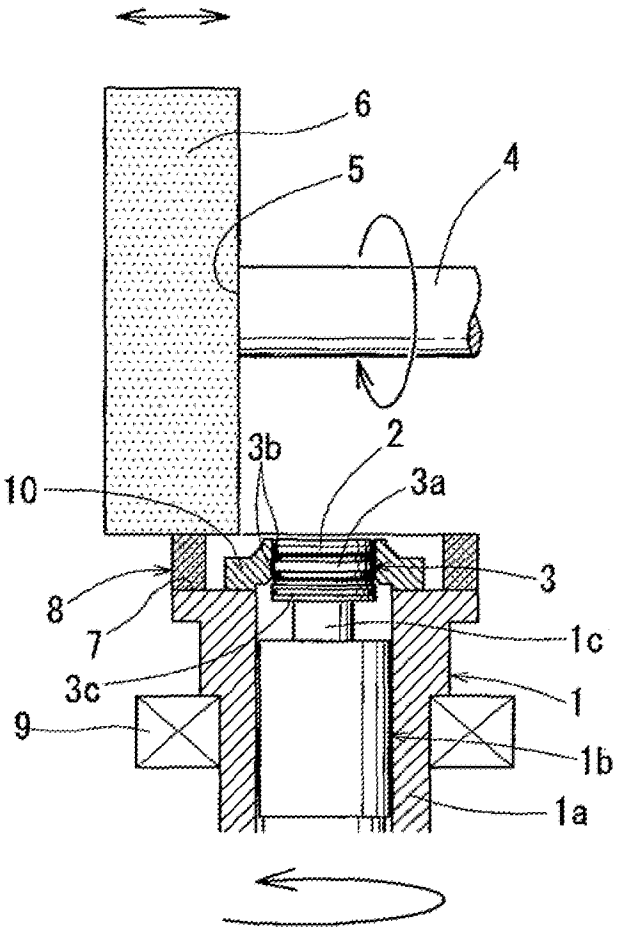
FIG. 5 is a vertical sectional view of the grinding device of FIG. 4, showing how the grinder is dressed.

FIG. 5 shows how the grinder 6 is dressed by the dresser tool 8. In this state, as in the first embodiment, with the workpiece W removed, the chuck 3 is retracted into the fixing ring 10, which is mounted on the front end of the outer cylindrical member 1*a*. On the other hand, the grinder shaft 4 is moved downward and also advanced further than during grinding so that the grinder 6 is pressed against the end surface of the ring-shaped dresser tool 8 mounted on the dresser head 7, which is rotating.

In the first and second embodiments, the chuck and the dresser head are moved axially relative to each other by moving the chuck only. But they may be moved axially relative to each other by moving both the dresser head and the chuck.

In the first and second embodiments, the workpiece is dismounted for dressing. But by adjusting the axial relative position between the chuck and the dresser head depending on the sizes of the workpiece and the dresser tool and the positional relationship therebetween, it is possible to carry out dressing with the workpiece fixed to the chuck.

Figure 6:
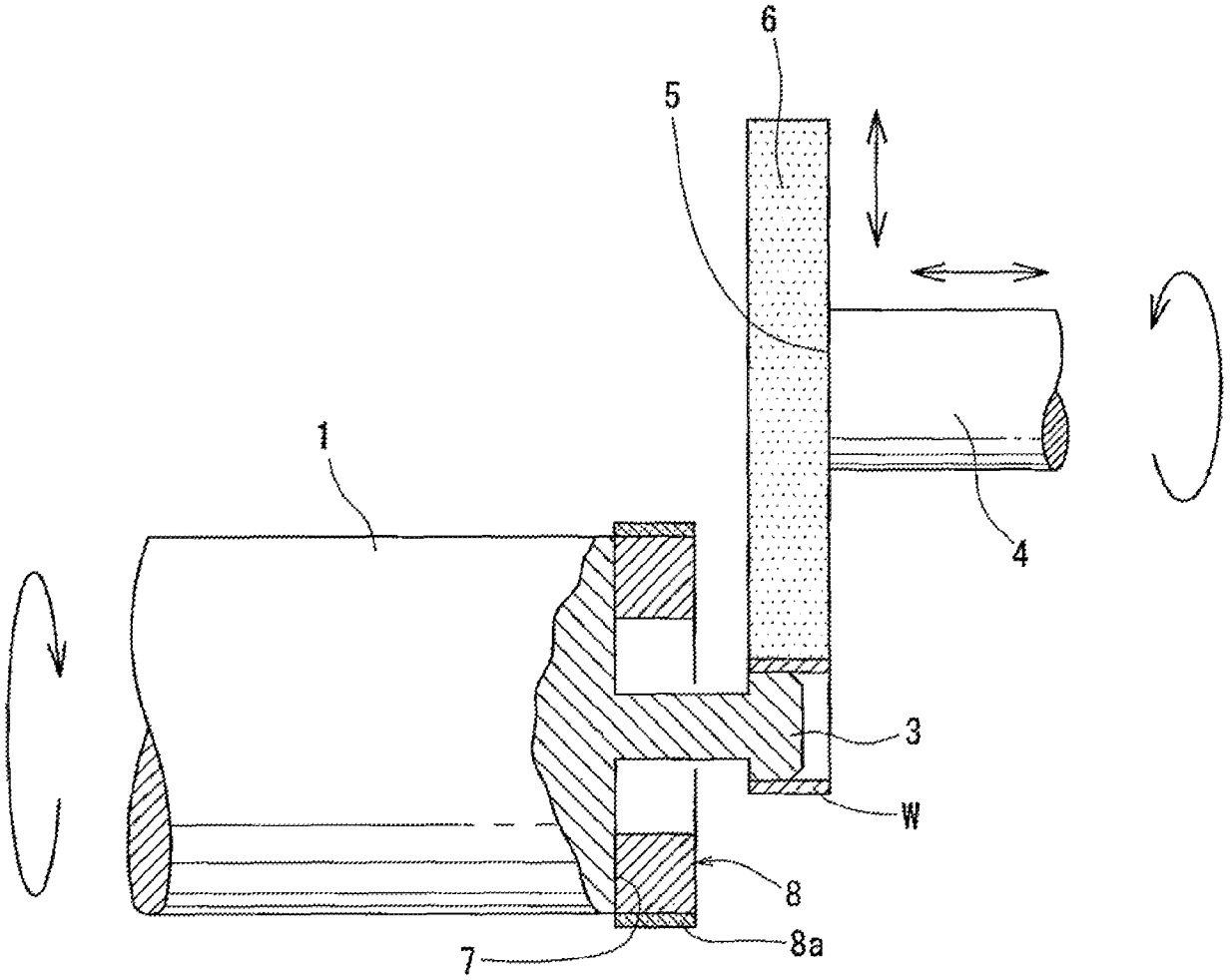
FIG. 6 is a vertical sectional view of a portion of a grinding device according to a third embodiment of the present invention.
Figure 7:
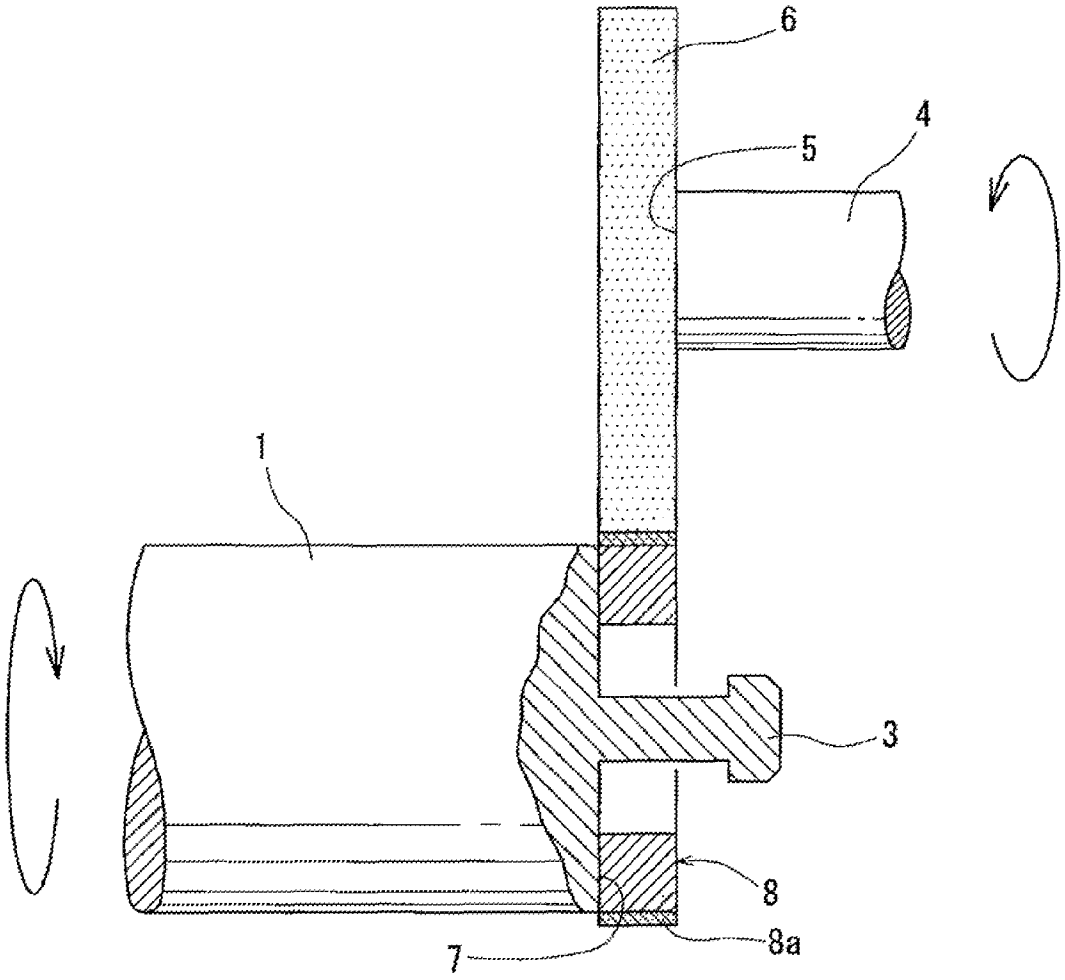
FIG. 7 is a vertical sectional view of the grinding device of FIG. 6, showing how the grinder is dressed.

FIGS. 6 and 7 show a grinding device of the third embodiment. As shown in FIG. 6, the chuck 3 at the front end of the spindle 1, which is rotated, supports the radially inner surface of a cylindrical workpiece W. In this embodiment, a disk-shaped grinder 6 is mounted on the grinder head 5 of the grinder shaft 4, which is rotated and extends parallel to the spindle 1, and configured to grind the radially outer surface of the workpiece W. A ring-shaped dresser tool 8 is mounted on a dresser head 7 at the front end of the spindle 1 radially outwardly of the chuck 3. The dresser tool 8 carries on its radially outer surface a dressing member 8*a* whose shape is determined according to its intended use. The grinder shaft 4 is movable in its axial direction and in the vertical direction, which is perpendicular to the axis of the grinder shaft 4. The chuck 3 for fixedly supporting the workpiece W is not limited to that shown but may be e.g. a known shoe magnet chuck.

FIG. 6 shows how the workpiece W, which is fixed to the chuck 3 at the front end of the spindle 1, is ground by the grinder 6. In this state, the grinder shaft 4 is advanced until the disk-shaped grinder 6 mounted on the rotating grinder head 5 is pressed against the radially outer surface of the workpiece W.

FIG. 7 shows how the grinder 6 is ground by the dresser tool 8. In this state, with the grinder shaft 4 advanced further and moved further upward than during grinding, the grinder 6 is pressed against the radially outer surface of the dresser tool 8, which is mounted on the rotating dresser head 7. During dressing, the workpiece W is dismounted from the chuck 3 in the embodiment. But dressing can be performed with the workpiece W fixed to the chuck 3.

Figure 8:
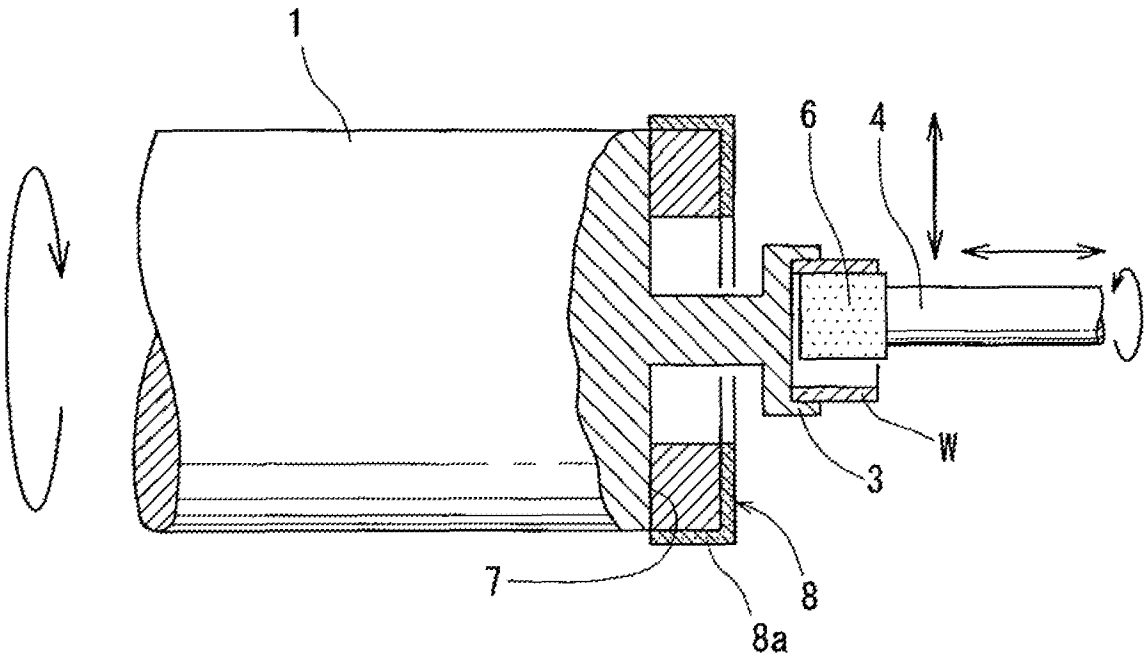
FIG. 8 is a vertical sectional view of a portion of a grinding device according to a fourth embodiment of the present invention.
Figure 9:
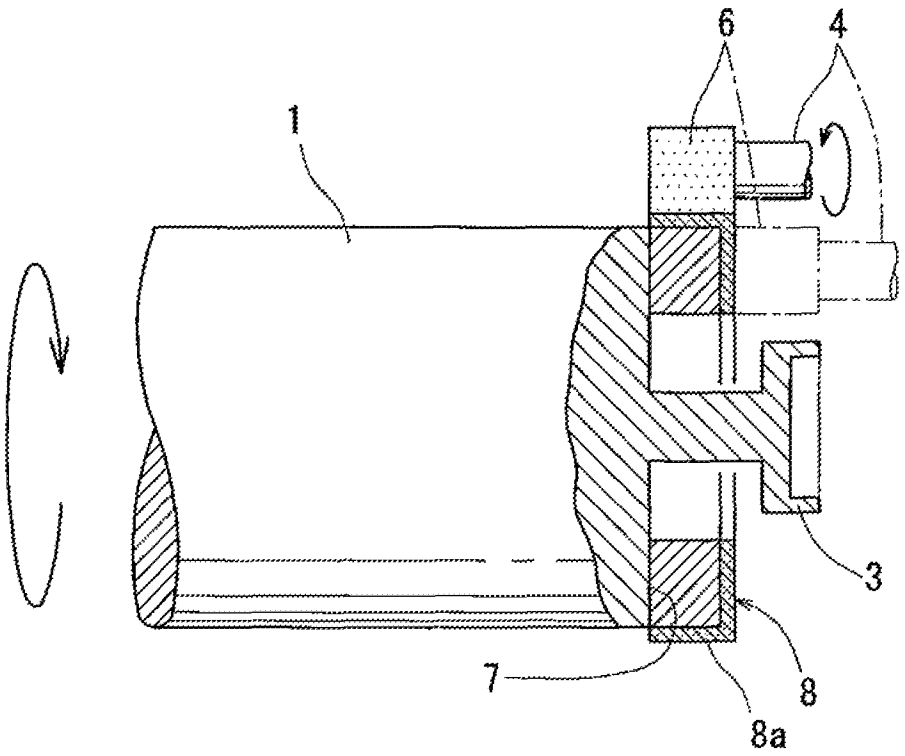
FIG. 9 is a vertical sectional view of the grinding device of FIG. 8, showing how the grinder is dressed.

FIGS. 8 and 9 show a grinding device of the fourth embodiment. As shown in FIG. 8, the chuck 3 at the front end of the spindle 1, which is rotated, supports the radially outer surface of a cylindrical workpiece W. In this embodiment, a columnar grinder 6 is mounted on the grinder head 5 of the grinder shaft 4, which is rotated and extends parallel to the spindle 1, and configured to grind the radially inner surface of the workpiece W. A ring-shaped dresser tool 8 is mounted on a dresser head 7 at the front end of the spindle 1 radially outwardly of the chuck 3. The dresser tool 8 carries on its radially outer surface and front end surface a dressing member 8*a* whose shape is determined according to its intended use. The grinder shaft 4 is movable in its axial direction and in the vertical direction, which is perpendicular to the axis of the grinder shaft 4. The chuck 3 for fixedly supporting the workpiece W is not limited to that shown but may be e.g. a known shoe magnet chuck or of the width clamp type.

FIG. 8 shows how the workpiece W is ground by the grinder 6. In this state, with the grinder shaft 4 advanced, the columnar grinder 6, which is mounted on the rotating grinder head 5, is pressed against the radially inner surface of the workpiece W, which is fixed to the chuck 3 at the front end of the spindle 1.

FIG. 9 shows how the dresser tool 8 dresses the radially outer surface of the columnar grinder 6. In this state, with the grinder shaft 4 moved further upward and further advanced than during grinding, the radially outer surface of the grinder 6 is pressed against the radially outer surface of the dresser tool 8, which is mounted on the rotating dresser head 7. To dress the end surface of the grinder 6, as shown by the dot-and-dash line in FIG. 9, the front end surface of the dresser tool 8 is pressed against the end surface of the grinder 6. In this embodiment too, during dressing, the workpiece W is dismounted from the chuck 3. But dressing may be carried out with the workpiece W fixed to the chuck 3.

The grinding device of any of the above embodiments is mainly and advantageously used to grind ring-shaped workpieces W such as bearing inner and outer races, and especially advantageously used to grind ring members for which high precision of end surfaces is required, such as an inner race which is fitted on a hub ring having a wheel-mounting flange with its end surface fixed to an inboard side of the hub ring, or inner and outer races of tapered roller bearings.

In the above embodiments, the spindle and the grinder shaft are moved relative to each other by moving the grinder shaft. But instead, the spindle only or both the spindle and the grinder shaft may be moved.

In the above embodiments, the dresser head is located radially outwardly of the chuck. But depending on the sizes and shapes of the workpiece and the dresser tool and the positional relationship therebetween, the dresser head may be located radially inwardly of the chuck. In this case, the workpiece is ground at a position radially outwardly of the dresser tool.

The invention claimed is:

1. A grinding device comprising:

a spindle which is configured to be rotated;

a chuck mounted on a front end of the spindle for fixedly holding a workpiece;

a grinder shaft having a grinder head;

a grinder mounted on the grinder head;

a dresser head provided at the front end of the spindle;

a dresser tool mounted on the dresser head for dressing the grinder; and a fixing ring mounted to the spindle;

wherein the spindle and the grinder shaft are movable relative to each other to positions where the workpiece can be ground by the grinder with the grinder held in position with respect to the chuck;

wherein the chuck is movable relative to the spindle in an axial direction of the spindle such that, when the workpiece is fixedly held by the chuck, the workpiece is movable by the chuck relative to the spindle in the axial direction of the spindle;

wherein the fixing ring is configured to fix an axial position of the workpiece in the axial direction of the spindle when the workpiece is moved by the chuck in the axial direction of the spindle;

wherein the fixing ring and the dresser tool are disposed at the front end of the spindle in such a manner that a front end surface of the fixing ring is positioned in an axially retracted position relative to a front end surface of the dresser tool; and wherein the dresser tool is configured such that while the workpiece is being ground by the grinder, the dresser tool is kept out of contact with the grinder, and while the grinder is being dressed by the dresser tool, the chuck is kept out of contact with the grinder.

2. The grinding device of claim 1, wherein the dresser head is fixed in position at a location radially outwardly of the chuck.

3. The grinding device of claim 2, which is a surface grinding machine wherein the spindle and the grinder shaft extend parallel to each other.

4. The grinding device of claim 2, which is a surface grinding machine wherein the spindle and the grinder shaft extend perpendicular to each other.

5. The grinding device of claim 1, which is a surface grinding machine wherein the spindle and the grinder shaft extend parallel to each other.

6. The grinding device of claim 1, which is a surface grinding machine wherein the spindle and the grinder shaft extend perpendicular to each other.

7. The grinding device of claim 1, wherein the front end surface of the fixing ring is disposed such that when the workpiece is held by the chuck and the chuck moves rearwardly relative to the spindle in the axial direction of the spindle, the workpiece is moved into the axial position of the workpiece due to abutment of a rear face of the workpiece against the front end surface of the fixing ring.

8. The grinding device of claim 7, wherein the dresser tool is ring shaped and is disposed surrounding the fixing ring.

9. The grinding device of claim 1, wherein the dresser tool is ring shaped and is disposed surrounding the fixing ring.

* * * * *